US005158692A

United States Patent [19]

Fabry et al.

[11] Patent Number: 5,158,692

[45] Date of Patent: Oct. 27, 1992

[54] WETTING AGENTS FOR USE IN AQUEOUS ALKALINE TREATMENT PREPARATION FOR YARNS OR SHEET-FORM TEXTILES

[75] Inventors: Bernd Fabry, Korschenbroich; Faize Berger, Duesseldorf; Bernd Wahle, Kaarst, all of Fed. Rep. of Germany

[73] Assignee: Henkel Kommanditgesellschaft aur Aktien, Dusseldorf, Fed. Rep. of Germany

[21] Appl. No.: 775,941

[22] PCT Filed: Apr. 19, 1990

[86] PCT No.: PCT/EP90/00628

§ 371 Date: Dec. 20, 1991

§ 102(e) Date: Dec. 20, 1991

[87] PCT Pub. No.: WO90/13700

PCT Pub. Date: Nov. 15, 1990

[30] Foreign Application Priority Data

Apr. 28, 1989 [DE] Fed. Rep. of Germany ..... 3914060

[51] Int. Cl.[5] ..... D06M 13/256; D06M 13/262; D06M 11/38

[52] U.S. Cl. ..... 252/8.75; 252/86; 252/87; 252/355; 252/353; 8/115.7

[58] Field of Search ..... 8/115.7; 252/8.7, 8.6, 252/353, 355, 8.75

[56] References Cited

U.S. PATENT DOCUMENTS

| | | | |
|---|---|---|---|
| 4,075,021 | 2/1978 | Kukuchi et al. | 430/393 |
| 4,877,896 | 10/1989 | Maedonado et al. | 560/14 |
| 4,929,366 | 5/1990 | Yamamoto et al. | 252/8.6 |

FOREIGN PATENT DOCUMENTS

| | | |
|---|---|---|
| EP299370 | 1/1989 | European Pat. Off. . |
| 3723354 | 1/1989 | Fed. Rep. of Germany . |
| 3809822 | 10/1989 | Fed. Rep. of Germany . |
| 266711A3 | 9/1983 | German Democratic Rep. . |
| WO/9013700 | 11/1990 | World Int. Prop. O. . |

*Primary Examiner*—Richard D. Lovering
*Assistant Examiner*—N. Bhat
*Attorney, Agent, or Firm*—Ernest G. Szoke; Wayne C. Jaeschke; Real J. Grandmaison

[57] ABSTRACT

The invention relates to mixtures which contain (A), unsaturated $C_{16-22}$ carboxylic acid $C_{16-22}$ alkenyl ester sulfonates and (B), at least one surfactant from the sulfate group and which are used as wetting agents in aqueous alkaline treatment preparations for yarns or sheet-form textiles.

14 Claims, No Drawings

WETTING AGENTS FOR USE IN AQUEOUS ALKALINE TREATMENT PREPARATION FOR YARNS OR SHEET-FORM TEXTILES

BACKGROUND OF THE INVENTION

1. Field of the Invention

This invention relates to the use of mixtures containing (A), unsaturated $C_{16-22}$ carboxylic acid $C_{16-22}$ alkenyl ester sulfonates and (B), at least one surfactant from the group of sulfates as wetting agents in aqueous alkaline treatment preparations for yarns or sheet-form textiles.

2. Discussion of Related Art

Cotton contains natural impurities, for example waxes, wax-like substances, proteins, seed shells, fruit husks and pectins and also impurities which are applied as foreign substances in the course of processing, such as paraffins and/or mineral oils. The impurities in wool, regenerated fibers, such as viscose rayon, and synthetic fibers, such as polyester and polyamide, emanate from the treatment of these materials with finishes (Chwala-/Anger in "Handbuch der Textilhilfsmittel", pages 526–528, 537, 558 et seq., Verlag Chemie Weinheim 1977). In order completely to remove these impurities mentioned by way of example, textile fibers, particularly cellulose-containing textile fibers, are normally subjected to a pretreatment.

Aqueous treatment preparations for the pretreatment and bleaching of natural fibers, such as cotton, or of mixtures of natural and synthetic fibers, such as cotton/polyester or cotton/polyamide, require the addition of wetting agents to obtain relatively quick and intimate contact between the treatment preparation and the textile material. Mercerizing liquors, bleaches, cleaning preparations, boil-off preparations and degreasing preparations are examples of pretreatment and bleaching preparations. Wetting agents present in treatment preparations such as these must be soluble in water and stable to alkalis and must guarantee uniform wetting of the textile material In addition, they should be able to be easily added to the treatment preparations, i.e. should be present in liquid form at room temperature. In addition, wetting agents must be ecologically acceptable, i.e. must be readily biodegradable and non-toxic to aquatic organisms.

The object of the present invention was to develop liquid, water-soluble and alkali-stable wetting preparations which may be used in alkaline treatment preparations for sheet-form textiles or yarns.

Description of the Invention

Other than in the operating examples, or where otherwise indicated, all numbers expressing quantities of ingredients or reaction conditions used herein are to be understood as modified in all instances by the term "about".

It has been found that the stringent requirements which wetting agents have to meet are largely satisfied by sulfonated, unsaturated $C_{16-22}$ carboxylic acid $C_{16-22}$ alkenyl esters in combination with at least one surfactant from the group of sulfates.

Accordingly, the present invention relates to the use of mixtures containing (A)$_1$ unsaturated $C_{16-22}$ carboxylic acid $C_{16-22}$ alkenyl ester sulfonates in the form of their alkali metal, alkaline earth metal, ammonium and/or amine salts and (B)$_1$ $C_{6-18}$ alkyl and/or $C_{16-18}$ alkenyl sulfates in the form of their alkali metal, alkaline earth metal, ammonium and/or amine salts and/or glycerol ether sulfates in the form of their alkali metal, alkaline earth metal, ammonium and/or amine salts, prepared by base-catalyzed reaction of glycerol and/or alkoxylated glycerols with $C_{1-10}$ alkyl halides and subsequent sulfatization of the glycerol ethers formed and/or sulfatized hydroxyalkyl alkylpolyalkylene glycol ethers corresponding to general formula I $$R-O-(C_nH_{2n}O)_x-CH_2-\underset{\underset{OSO_3M}{|}}{CH}-R^1$$

in which R is an alkyl radical containing 1 to 6 carbon atoms, $R^1$ is an alkyl radical containing 6 to 18 carbon atoms, M is an alkali metal and/or ammonium cation, n is the number 2 or 3 and x is a number of 2 to 10, in a ratio by weight of A:B of 5:1 to 1:5 as wetting agents in aqueous alkaline treatment preparations for yarns or sheet-form textiles.

Mixtures in which the ratio by weight of component A to component B is from 4:1 to 1:1 are preferably used as wetting agents.

Sulfonated, unsaturated $C_{16-22}$ carboxylic acid $C_{16-22}$ alkenyl esters are known compounds which may be obtained in accordance with DE 38 09 322 by sulfonation of esters—prepared by reaction of unsaturated $C_{16-22}$ carboxylic acids with $C_{16-22}$ alkenyl alcohols—and subsequent neutralization of the sulfonation products with aqueous solutions of alkali metal and/or alkaline earth metal hydroxides, for example NaOH or KOH, ammonia or amines, such as ethanolamine or triethanolamine. Suitable sulfonating agents are, in particular, $SO_3$-containing gas mixtures, for example $SO_3$/-nitrogen or $SO_3$/air mixtures, having $SO_3$ contents of from 1 to 10% by volume. 0.6 to 1.8 mol $SO_3$ and preferably 1.0 to 1.3 mol $SO_3$ is used per mol olefinic double bond. The preparation of the sulfonated esters is carried out continuously or discontinuously in standard reactors suitable and typically used for the sulfonation of fatty acid esters, alkyl benzenes or olefins, preferably of the falling film type, at temperatures in the range from 15° to 80° C. Suitable carboxylic acid components for the esters to be sulfonated are unsaturated $C_{16-22}$ carboxylic acids of natural and/or synthetic origin, preferably unsaturated fatty acids containing 16 to 22 carbon atoms, for example palmitoleic acid, oleic acid, petroselic acid, gadoleic acid and/or erucic acid and/or technical grade fatty acid mixtures consisting predominantly of unsaturated $C_{16-22}$ fatty acids. Fatty acids, fatty acid mixtures and technical grade fatty acid mixtures are obtained from vegetable and/or animal oils and/or fats, for example beef tallow, lard, rapeseed oil, soybean oil and/or sunflower oil. Depending on the fats and/or oils used, technical grade fatty acid mixtures may contain small amounts of saturated $C_{16-22}$ fatty acids which, however, are not problematical. The alcohol component of the esters to be sulfonated may be selected from $C_{16-22}$ alkenyl alcohols of natural and/or synthetic origin, preferably unsaturated fatty alcohols containing 16 to 22 carbon atoms, for example palmitoleyl alcohol, oleyl alcohol, gadoleyl alcohol and/or erucyl alcohol and/or technical grade fatty alcohol mixtures consisting predominantly of unsaturated $C_{16-22}$ fatty alcohols. The saturated fatty alcohols present in technical fatty alcohol mixtures are not problematical. Fatty alcohols, fatty alcohol mixtures and technical grade fatty alcohol mixtures may be obtained by known methods from the vegetable and/or animal oils and/or fats mentioned by way of example above. Examples of particularly preferred unsaturated fatty acid fatty alkyl esters are erucyl erucate and/or oleyl oleate.

Alkyl and/or alkenyl sulfates in the form of their alkali metal, alkaline earth metal, ammonium and/or amine salts are prepared in known manner by sulfatization of the corresponding alkyl and/or alkenyl alcohols with chlorosulfonic acid or sulfur trioxide. The resulting sulfuric acid semiesters of the alcohols are subsequently neutralized with, for example, alkali metal hydroxide, such as sodium hydroxide, aqueous solutions of alkaline earth metal hydroxides, ammonia or alkanolamines, such as monoethanolamine or triethanolamine (Winnacker/Küchler in "Chemische Technologie", Vol. 7, pages 120–123, Carl-Hanser-Verlag, München-Wien, 1986). The educts alkyl and/or alkenyl alcohols may be linear and/or branched and of natural and/or synthetic origin. Alkyl alcohols contain 6 to 18 carbon atoms and preferably 8 to 12 carbon atoms while alkenyl alcohols contain 16 to 18 carbon atoms. Examples of alkyl and/or alkenyl alcohols are hexyl, octyl, 2-ethylhexyl, decyl, lauryl, myristyl, cetyl, stearyl, oleyl alcohol and also mixtures of these alcohols. Glycerol ether sulfates in the form of their alkali metal, alkaline earth metal, ammonium and/or amine salts may be obtained by base-catalyzed reactions of glycerol and/or alkoxylated glycerols with twice the stoichiometric quantities of alkyl halides, preferably alkyl chlorides (Williamson's synthesis). The alkyl halides may be linear and/or branched and contain 1 to 10 carbon atoms and preferably 4 to 8 carbon atoms. The OH groups of the glycerol ethers formed are sulfatized under the conditions described above and the sulfuric acid semiesters formed are subsequently neutralized.

Sulfatized hydroxyalkyl alkylpolyalkylene glycol ethers may be obtained in accordance with EP 299 370 by sulfatization of hydroxyalkyl alkyl polyalkylene glycol ethers corresponding to general formula II $$R-O-(C_nH_{2n}O)_x-CH_2-\underset{\underset{OH}{|}}{CH}-R^1$$

with chlorosulfonic acid and/or $SO_3$/inert gas mixtures and subsequent neutralization, for example with alkali metal hydroxides, such as sodium hydroxide, ammonia, or amines, such as $C_{1-4}$ alkyl amines or triethanolamine. The ethers corresponding to general formula II may be obtained in accordance with EP 299 370 by reaction of epoxides corresponding to general formula III

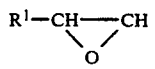

with alkoxylated, linear or branched alkyl alcohols corresponding to general formula IV $$R-O-(C_nH_{2n}O)_x-H$$

at temperatures in the range from 100° to 180° C. and preferably at temperatures in the range from 150° to 160° C in the presence of catalysts, for example sodium methylate. Suitable sulfatized hydroxyalkyl alkylpolyalkylene glycol ethers are those corresponding to general formula I, in which R is a linear or branched $C_{1-6}$ alkyl radical, $R^1$ is a linear or branched $C_{6-18}$ alkyl radical, M is an alkali metal and/or ammonium cation, n is the number 2 or 3 and x is a number of 2 to 10. Sulfatized hydroxyalkyl alkylpolyalkylene glycol ethers corresponding to general formula I, in which R is a linear or branched $C_{2-5}$ alkyl radical, $R^1$ is a L linear or branched $C_{8-16}$ alkyl radical, M is an alkali metal cation, n is the number 2 and x is a number of 2 to 6, are preferably used in the mixtures according to the invention.

The mixtures containing components (A) and (B), to be used as wetting agents in accordance with the invention are prepared by mixing at temperatures in the range from 18° to 25° C. Where the mixtures contain several surfactants from the group of sulfates, the sulfates may be used in any mixing ratio to one another. The mixtures to be used in accordance with the invention may contain linear and/or branched $C_{2-12}$ alkyl alcohols of natural and/or synthetic origin, for example 2-ethyl hexanol, n-octanol and/or n-decanol, and/or foam inhibitors, for example alkyl phosphates, such as tri-n-butyl phosphate, and/or dialkyl polyalkylene glycol ethers, such as $C_{12-18}$ coconut oil fatty alkyl $(OCH_2CH_2)_5$-O-n-butyl, as further constituents. The ratio by weight of components (A), and (B), to the optional constituents is from 10:1 to 1:1.

The mixtures according to the invention are clear, aqueous, neutral to alkaline solutions having active substance contents of 30 to 80% by weight. They may readily be incorporated in pretreatment preparations and bleaches for preferably cellulose-containing yarns or sheet-form textiles, such as woven or knitted fabrics, and are distinguished by good wetting properties coupled with high alkali stability. The mixtures according to the invention may be used in alkaline cold bleach liquors, hot bleach liquors, mercerizing liquors, alkaline boil-off and degreasing preparations, desizing processes and/or for improving liquor uptake in dyeing processes. The content of the mixtures to be used in accordance with the invention without optional constituents in the liquors is from 3.0 to 10 g/l based on active substance.

Aqueous alkaline bleach liquors, in which the mixtures to be used in accordance with the invention are preferably used, contain hydrogen peroxide or compounds which form hydrogen peroxide in aqueous solution as bleaching agent. The pH value of these bleaches is adjusted to pH 10–14 with bases, for example with NaOH and/or KOH. The bleach liquors used to bleach natural fibers, for example cotton and/or wool, or mixtures of natural and synthetic fibers, for example cotton/polyester or cotton/polyamide, typically contain—per liter—from 10 to 100 ml 35% by weight hydrogen peroxide, from 5 to 20 g bases from the group consisting of sodium hydroxide and/or potassium hydroxide, from 5 to 50 ml stabilizers, for example soda waterglass ($Na_2O:SiO_2=1:2$, 38° to 40° Be) and/or ethylenediaminetetraacetic acid in the form of its salts and/or polyphosphates, 0.1 to 1.0 g magnesium salts, for example magnesium sulfate, 0.5 to 10 g sequestering agents, for example Securon$^{(R)}$540, a product of Henkel KGaA, and from 3 to 10 g, based on active substance, of the mixtures to be used in accordance with the invention without optional constituents. The sheet-form textiles are bleached at temperatures in the range from 15° to 90° C. and preferably at a temperature of approximately 20° C. (cold bleaching).

EXAMPLES

1. Preparation of mixtures containing components (A), and (B), (according to the invention)

a) 40 g aqueous oleyl oleate disulfonate, disodium salt, 62% by weight, 20 g aqueous 2-ethylhexyl sulfate, sodium salt, 35% by weight, 20 g 2-ethyl hexanol and 20 g $C_{12-18}$ coconut oil fatty alcohol ×5 mol ethylene oxide, reacted with n-butyl chloride, 98% by weight, were stirred in a stirred vessel at 22° C. until a homogeneous mixture had formed.

b) A mixture of 45 g aqueous oleyl oleate disulfonate, sodium salt, 62% by weight, 45 g aqueous glycerol ether sulfate, sodium salt, prepared by base-catalyzed reaction of glycerol with n-hexyl chloride and subsequent sulfatization with $SO_3$, 29% by weight, and 10 g tri-n-butyl phosphate was prepared as in 1.a).

c) A mixture of 38 g aqueous oleyl oleate disulfonate, sodium salt, 62% by weight, 40 g sulfatized hydroxyalkyl alkylpolyethylene glycol ether corresponding to general formula I (R=n-butyl, $R^1$=n-decyl, M=Na, n=2 and x=2; 56% by weight aqueous solution), 20 g $C_{12-18}$ coconut oil fatty alcohol ×5 mol ethylene oxide, reacted with n-butyl chloride, 98% by weight, and 2 g 2-ethyl hexanol was prepared as in 1.a).

2. Preparation of mixtures containing only components (A), or only component (B), (comparison)

a) A mixture of 60 g aqueous 2-ethylhexyl sulfate, disodium salt, 35% by weight, 20 g 2-ethyl hexanol and 20 g $C_{12-18}$ coconut oil fatty alcohol ×5 mol ethylene oxide, reacted with n-butyl chloride, 98% by weight, was prepared as in 1.a).

b) A mixture of 90 g aqueous glycerol ether sulfate, sodium salt, prepared by base-catalyzed reaction of glycerol with n-hexyl chloride and subsequent sulfatization with $SO_3$, 29% by weight, and 10 g tri-n-butyl phosphate was prepared as in 1.a). c) A mixture of 78 g aqueous, sulfatized hydroxyalkyl alkyl polyethylene glycol ether corresponding to general formula I (R=n-butyl, $R^1$=n-decyl, M=Na, n=2 and x=2; 56% by weight), 20 g $C_{12-18}$ coconut oil fatty alcohol ×5 mol ethylene oxide, reacted with n-butyl chloride, 98% by weight, and 2 g 2-ethyl hexanol was prepared as in 1.a).

d) 100 g aqueous oleyl oleate disulfonate, disodium salt, 21% by weight, with no further constituents.

3. Determination of wetting power

Immersion wetting power was determined in a cold bleach liquor at 20° C. in accordance with DIN 53 901. The cold bleach liquor contained—per liter liquor—0.15 g $MgSO_4 \cdot 7H_2O$, 15 ml soda waterglass, 38/40° ° Be, 16 ml 50% by weight sodium hydroxide, 2 g complexing agent (Securon$^{(R)}$ 540, a product of Henkel KGaA), 35 ml 35% by weight hydrogen peroxide and a wetting agent mixture according to 1. or 2. The results are shown in Table 1.

| Wetting agent | | Quantity (g/l) | Wetting time (secs.) |
|---|---|---|---|
| 1a | Invention | 8.6 | <2 |
| 1b | | 10.9 | 3 |
| 1c | | 6.7 | <2 |
| 2a | Comparison | 10.9 | 65 |
| 2b | | 17 | 30 |
| 2c | | 7 | 2 |
| 2d | | 21 | 22 |

4. Determination of alkali stability

Alkali stability was determined after 1 hour at 20° C. in cold bleach liquors having the above compositions. The results are shown in Table 2.

| Wetting agent | | Quantity (g/l) | Alkali stability |
|---|---|---|---|
| 1a | Invention | 8.6 | good |
| 1b | | 10.9 | good |
| 1c | | 6.7 | good |
| 2a | Comparison | 10.9 | moderate |
| 2b | | 17 | poor |
| 2c | | 7 | good |
| 2d | | 21 | very good |

4. Determination of foaming power

The foaming power of cold bleach liquors having the above composition was determined in accordance with DIN 53 902 in a Götte foaming apparatus.

| Wetting agent | | Quantity (g/l) | Foam (ml) |
|---|---|---|---|
| 1a | Invention | 8.6 | 20 |
| 1b | | 10.9 | 30 |
| 1c | | 6.7 | 150 |
| 2a | Comparison | 10.9 | 120 |
| 2b | | 17 | 130 |
| 2c | | 7 | 150 |
| 2d | | 21 | 150 |

We claim:

1. A wetting agent mixture for use in aqueous alkaline treatment preparations for yarns or sheet-form textiles, said mixture comprising (A) a sulfonated, unsaturated $C_{16}$–$C_{22}$ carboxylic acid $C_{16}$–$C_{22}$ alkenyl alcohol ester in the form of its alkali metal, alkaline earth metal, ammonium or amine salt, and (B) at least one wetting agent selected from the group consisting of a $C_6$–$C_{18}$ alkyl or $C_{16}$–$C_{18}$ alkenyl alcohol sulfate in the form of its alkali metal, alkaline earth metal, ammonium or amine salt; a glycerol ether sulfate in the form of its alkali metal, alkaline earth metal, ammonium or amine salt, said glycerol ether sulfate having been prepared by the base-catalyzed reaction of glycerol or alkoxylated glycerol with a $C_1$–$C_{10}$ alkyl halide and subsequent sulfatization of the glycerol ether formed; and a sulfatized hydroxyalkyl alkylpolyalkylene glycol ether corresponding to the formula I $$R-O-(C_nH_{2n}O)_x-CH_2-\underset{\underset{OSO_3M}{|}}{CH}-R^1 \qquad (I)$$

in which R is an alkyl radical containing 1 to 6 carbon atoms, $R^1$ is an alkyl radical containing 6 to 18 carbon atoms, M is an alkali metal or ammonium cation, n is the number 2 or 3 and x is a number of about 2 to about 10, said component (A) and component (B) being present in a weight ratio of about 5:1 to about 1:5.

2. A wetting agent mixture as in claim 1 wherein said component (A) and component (B) are present in a weight ratio of about 4:1 to about 1:1.

3. A wetting agent mixture as in claim 1 wherein said glycerol ether sulfate has been prepared by the base-catalyzed reaction of glycerol with a $C_4$–$C_8$ alkyl chloride.

4. A wetting agent mixture as in claim 1 wherein in said sulfatized hydroxyalkyl alkylpolyalkylene glycol ether corresponding to formula I, R is an alkyl radical containing 2 to 5 carbon atoms, $R^1$ is an alkyl radical containing 8 to 16 carbon atoms, M is an alkali metal, n is the number 2 and x is a number of about 2 to about 6.

5. A wetting agent mixture as in claim 1 wherein said alkyl alcohol sulfate contains 8 to 12 carbon atoms.

6. A wetting agent mixture as in claim 1 present in said treatment preparations in an amount of from about 3 to about 10 g./l. of said preparations.

7. A wetting agent mixture as in claim 1 wherein said yarns or sheet-form textiles contain natural fibers.

8. The process of treating yarns or sheet-form textiles, comprising contacting said yarns or textiles with an aqueous alkaline composition containing a wetting agent mixture comprising (A) a sulfonated, unsaturated $C_{16}$–$C_{22}$ carboxylic acid $C_{16}$–$C_{22}$ alkenyl alcohol ester in the form of its alkali metal, alkaline earth metal, ammonium or amine salt, and (B) at least one wetting agent selected from the group consisting of a $C_6$–$C_{18}$ alkyl or $C_{16}$–$C_{18}$ alkenyl alcohol sulfate in the form of its alkali metal, alkaline earth metal, ammonium or amine salt; a glycerol ether sulfate in the form of its alkali metal, alkaline earth metal, ammonium or amine salt, said glycerol ether sulfate having been prepared by the base-catalyzed reaction of glycerol or alkoxylated glycerol with a $C_1$–$C_{10}$ alkyl halide and subsequent sulfatization of the glycerol ether formed; and a sulfatized hydroxyalkyl alkylpolyalkylene glycol ether corresponding to formula I $$R-O-(C_nH_{2n}O)_x-CH_2-\underset{\underset{OSO_3M}{|}}{CH}-R^1 \qquad (I)$$

in which R is an alkyl radical containing 1 to 6 carbon atoms, $R^1$ is an alkyl radical containing 6 to 18 carbon atoms, M is an alkali metal or ammonium cation, n is the number 2 or 3 and x is a number of about 2 to about 10, said component (A) and component (B) being present in a weight ratio of about 5:1 to about 1:5.

9. The process as in claim 8 wherein said component (A) and component (B) are present in a weight ratio of about 4:1 to about 1:1.

10. The process as in claim 8 wherein said glycerol ether sulfate has been prepared by the base-catalyzed reaction of glycerol with a $C_4$–$C_8$ alkyl chloride.

11. The process as in claim 8 wherein in said sulfatized hydroxyalkyl alkylpolyalkylene glycol ether corresponding to formula I, R is an alkyl radical containing 2 to 5 carbon atoms, $R^1$ is an alkyl radical containing 8 to 16 carbon atoms, M is an alkali metal, n is the number 2 and x is a number of about 2 to about 6.

12. The process as in claim 8 wherein said alkyl alcohol sulfate contains 8 to 12 carbon atoms.

13. The process as in claim 8 wherein said wetting agent mixture is present in said aqueous alkaline composition in an amount of from about 3 to about 10 g./l. of said composition.

14. The process as in claim 8 wherein said yarns or sheet-form textiles contain natural fibers.

* * * * *